United States Patent [19]

Ishiguro

[11] Patent Number: 4,670,952

[45] Date of Patent: Jun. 9, 1987

[54] BUCKLE APPARATUS

[75] Inventor: Kazuyoshi Ishiguro, Aichi, Japan

[73] Assignee: Kabushiki Kaisha Tokai-rika-denki-seisakusho, Aichi, Japan

[21] Appl. No.: 817,093

[22] Filed: Jan. 8, 1986

[30] Foreign Application Priority Data

Jan. 11, 1985 [JP] Japan ..... 60-2202[U]

[51] Int. Cl.[4] ..... A44B 11/25

[52] U.S. Cl. ..... 24/641; 24/636; 24/639

[58] Field of Search ..... 24/641, 642, 643, 647, 24/636, 637, 638, 639, 635, 650, 652, 655, 656

[56] References Cited

U.S. PATENT DOCUMENTS

| | | | |
|---|---|---|---|
| 3,969,795 | 7/1976 | Stephenson | 24/655 |
| 4,068,354 | 1/1978 | Loomba et al. | 24/641 |
| 4,069,557 | 1/1978 | Loomba et al. | 24/641 |
| 4,096,606 | 6/1978 | Stephenson | 24/655 |
| 4,228,567 | 10/1980 | Ikesue et al. | 24/642 |
| 4,310,952 | 1/1982 | Robben et al. | 24/641 |
| 4,339,854 | 7/1982 | Ikesue | 24/639 |
| 4,450,604 | 5/1984 | Oowada | 24/641 |
| 4,451,958 | 6/1984 | Robben et al. | 24/636 |
| 4,454,634 | 6/1984 | Haglund et al. | 24/641 |

FOREIGN PATENT DOCUMENTS

| | | | |
|---|---|---|---|
| 0040143 | 11/1981 | European Pat. Off. | 24/641 |
| 2073810 | 10/1981 | United Kingdom | 24/637 |

*Primary Examiner*—Victor N. Sakran

*Attorney, Agent, or Firm*—Sixbey, Friedman & Leedom

[57] ABSTRACT

A buckle apparatus for use in a seatbelt system for a vehicle designed to protect an occupant in an emergency situation of the vehicle includes a buckle body into which a tongue plate is inserted. A lock plate is moved in a direction orthogonal to the tongue plate inserting direction and is engaged with an opening formed in the tongue plate, and portions of the lock plate on both sides of its portion engaged with the tongue plate are supported by the buckle body, thereby reliably obtaining a sufficiently large tongue plate holding strength. When the force applied to the tongue plate such as to pull it out from the buckle apparatus is relatively small, a resilient member retains the lock plate, together with the tongue plate, in such a manner that they are separated from the engaging portions of the buckle body. When the tongue plate is to be disengaged from the buckle apparatus by operating a release button, the lock plate is slid on the resilient member, thereby allowing the tongue plate to be pulled out with a reduced operating force.

24 Claims, 9 Drawing Figures

BUCKLE APPARATUS

BACKGROUND OF THE INVENTION

1. Field of the Invention

The present invention relates to a buckle apparatus for use in a seatbelt system for a vehicle designed to protect an occupant in an emergency situation of the vehicle.

2. Description of the Related Art

A typical conventional buckle apparatus for use in a seatbelt system for a vehicle has heretofore been arranged such that an occupant can be fastened by an occupant restraining webbing by engaging a tongue plate connected to an end or intermediate portion of the webbing with the buckle apparatus.

There are various types of buckle apparatus. One of them is a latch type buckle apparatus in which, as shown in FIG. 9, a tongue plate 12 is engaged with a lock member 10 which has its two ends respectively supported by buckle body members 14. This latch type buckle apparatus has a large tongue plate holding strength and hence extremely high engagement reliability. In this buckle apparatus, disengagement of the tongue plate 12 is effected by sliding the lock member 10 upwardly as viewed in FIG. 9.

In this type of buckle apparatus, the respective joint or slide surfaces of the lock member 10 and the buckle body members 14 may gradually become worn and roughened as a result of repetitive use of the seatbelt system, which leads to an increase in the force required for disengaging the tongue plate 12 and hence causes operability to be deteriorated.

SUMMARY OF THE INVENTION

In view of the above circumstances, it is a primary object of the present invention to provide a buckle apparatus which has high tongue plate engagement reliability and a large tongue plate holding strength and which involves no risk of the force required for disengaging the tongue plate increasing.

To this end, the present invention provides a buckle apparatus arranged such that the condition in which the tongue plate is supported differs depending upon whether the buckle apparatus is in a high-load state wherein a relatively large pulling force is acting on the tongue plate, or in a low-load state wherein the tongue plate is being disengaged.

More specifically, the buckle apparatus according to the present invention comprises: a buckle body; a lock plate movable relative to the buckle body in the direction in which a tongue plate is inserted into and pulled out of the buckle body and also in a direction orthogonal to said direction, portions of the lock plate on the upper and lower sides of its intermediate portion engaged with the tongue plate being able to abut against the buckle body so as to be retained thereby when the lock plate is pulled by the tongue plate; biasing means capable of resiliently pressing the lock plate in the direction opposite to the direction in which the lock plate is pulled by the tongue plate; and a lever pivotally disposed on the buckle body and having the function of leverage which enables the lock plate to be moved in a direction orthogonal to the tongue plate inserting direction, thereby disengaging the lock plate and the tongue plate from each other.

According to the buckle apparatus with the above arrangement, the lock plate is supported by the buckle body through the biasing means in a normal state wherein the tongue plate and the buckle apparatus are not engaged with each other, or in a low-load state wherein the tongue plate and the buckle apparatus are engaged with each other and no relatively large pulling force is acting on the tongue plate.

In a high-load state wherein the tongue plate and the buckle apparatus are engaged with each other and a relatively large pulling force is acting on the tongue plate, the lock plate is pulled by the tongue plate against the biasing force of the biasing means so as to move relative to the buckle body in the direction in which the tongue plate is pulled out of the buckle body, and portions of the lock plate on the upper and lower sides of its intermediate portion engaged with the tongue plate abut against the buckle body so as to be retained thereby. When, in this state, the pulling force becomes relatively small, the lock plate is pressed by the biasing means so as to move in the tongue plate inserting direction and is thereby returned to its position in the low-load state.

When the tongue plate is disengaged from the buckle apparatus, the lock plate is moved in the direction orthogonal to the tongue plate inserting direction by the action of the lever while the lock plate is being supported by the buckle body through the biasing means.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which:

FIGS. 1 to 7 show in combination one embodiment of the buckle apparatus according to the present invention, of which:

FIG. 1 is an exploded perspective view of the buckle apparatus;

FIG. 2 is a plan view of the buckle apparatus in engagement with the tongue plate;

FIG. 3 is a sectional view taken along the line III—III of FIG. 2;

FIG. 4 is a side view of the buckle apparatus before the insertion of the tongue plate;

FIG. 5 is a side view of the buckle apparatus in engagement with the tongue plate;

FIG. 6 is a side view of the buckle apparatus in a high-load state; and

FIG. 7 is a side view of the buckle apparatus during the operation of disengaging the tongue plate.

DESCRIPTION OF THE PREFERRED EMBODIMENT

Figure 1:
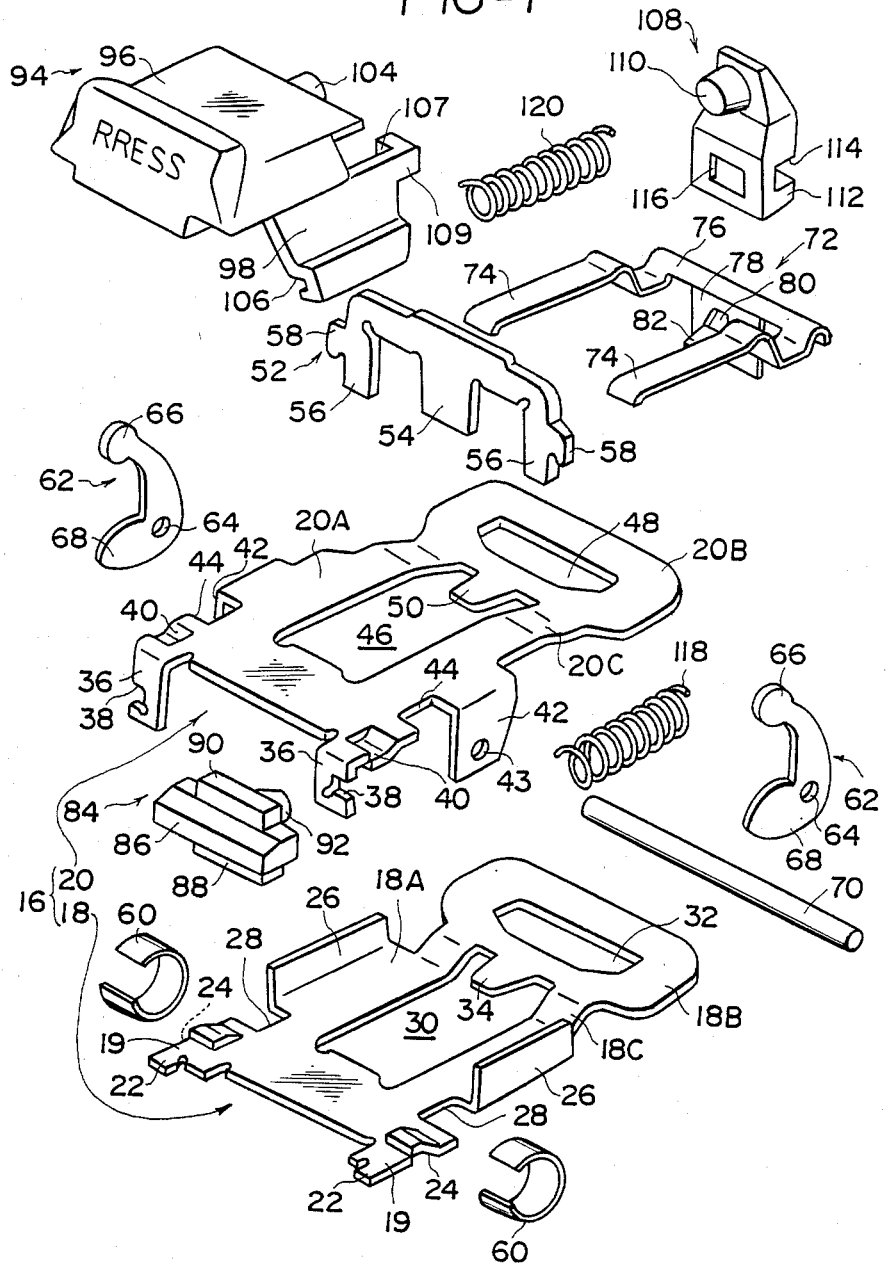

FIGS. 1 to 7 show in combination one embodiment of the buckle apparatus according to the present invention. Each of the constituent elements of the buckle apparatus will first be described with reference to FIG. 1.

A buckle body 16 is constituted by a lower body member 18 and an upper body member 20.

The lower body member 18 is formed from a single steel plate having a necessary strength. The lower body member 18 is constituted by a front flat plate portion 18A, a rear flat plate portion 18B and a slanted portion 18C which connects together the front and rear flat plate portions 18A and 18B, the slanted portion 18C extending obliquely upward from the portion 18A to the portion 18B. The front flat plate portion 18A has front leg portions 19 extending forwardly from the extremities, respectively, of the front end of the portion 18A. The inner side of the front end portion of each of the front leg portions 19 is notched to provide a projection 22 in the form of a step. Recesses 24 are formed in the undersurface (as viewed in FIG. 1) of the front flat plate portion 18A and at respective positions to the rear of the front leg portions 19 by shearing and bending.

Side portions of the front flat plate portion 18A which are respectively located to the rear of the recesses 24 are bent at right angles so as to project upward, thus providing side leg portions 26. Notches 28 are formed between the recesses 24 and the side leg portions 26, respectively. A rectangular opening 30 is provided in the center of the lower body member 18 such that the opening 30 extends from the front flat plate portion 18A to the rear flat plate portion 18B. The portion 18B is provided with a trapezoidal opening 32 and a trapezoidal tongue 34 which extends into the opening 30.

The upper body member 20 is formed from a single steel plate having a necessary strength. The member 20 is constituted by a front flat plate portion 20A, a rear flat plate portion 20B and a slanted portion 20C which connects together the portions 20A and 20B, the portion 20C extending obliquely downward from the portion 20A to the portion 20B. Two portions at the extremities of the front end of the front flat plate portion 20A are bent downwardly at right angles so as to provide front leg portions 36. Each of the leg portions 36 is provided with a notch 38 at the outer side of the intermediate portion thereof. Recesses 40 are formed in the front flat plate portion 20A and at respective positions to the rear of the leg portions 36 by shearing and bending.

Side portions of the front flat plate portion 20A which are located to the rear of the recesses 40 are bent downwardly at right angles, thus providing side leg portions 42. A through-hole 43 is provided in each of the leg portions 42. The distance between the side leg portions 42 is set such as to be larger than that between the side leg portions 26 formed on the lower body member 18. Notches 44 are formed between the recesses 40 and the side leg portions 42, respectively. A rectangular opening 46 is provided in the center of the upper body member 20 such that the opening 46 extends from the front flat plate portion 20A to the rear flat plate portion 20B. The rear flat plate portion 20B is provided with a trapezoidal opening 48 and a trapezoidal tongue 50 which extends into the opening 46.

A lock plate 52 is formed from a single steel plate having a necessary strength by shaping the plate into a substantially E-shaped configuration. The leg portion which projects from the center of the plate 52 defines a tongue plate engaging portion 54, while the leg portions which project from two ends of the plate 52 define spring abutting portions 56, respectively. A lever abutting portion 58 is formed on each of the spring abutting portions 56, the portion 58 projecting outwardly in the lateral direction of the lock plate 52.

Each of the C-shaped springs 60 is constituted by a leaf spring having a substantially C-shaped cross-section. When the spring 60 is deformed by pressure, deformation or strain energy is stored therein.

Each of the L-shaped levers 62 is constituted by a plate material formed in a substantially L-shaped configuration. A through-hole 64 is provided at the elbow portion of each lever 62. The long side of each L-shaped lever 62 defines a release button abutting portion 66, while the short side defines a lock plate abutting portion 68. It is to be noted that the leverage of each of the levers 62 is set at about 2:1.

A bar 70 is constituted by a columnar bar material. The levers 62 and the bar 70 may be integrally molded from a synthetic resin.

A lock plate spring 72 is constituted by a leaf spring having a substantially U-shaped planar configuration. The spring 72 consists of a pair of leg portions 74 and a connecting portion 76 which connects together the portions 74. A portion 78 which is to be secured to the buckle body 16 extends downwardly from the connecting portion 76. The central portion of the portion 78 is cut and bent at right angles, thereby providing a trapezoidal opening 80 and a trapezoidal tongue 82.

An ejector 84 is composed of a body portion 86, a lower guide portion 88, an upper guide portion 90 and a spring supporting portion 92, which are integrally molded. The body portion 86 has a substantially rectangular parallelepiped configuration with a slanted surface formed on the upper surface of its front portion. Each of the lower and upper guide portion 88 and 90 has the shape of a rectangular parallelepiped the lateral dimension of which is shorter than that of the body portion 86, and they are respectively positioned at the lower and upper sides of the rear central portion of the body portion 86. The spring supporting portion 92 has a substantially frustoconical configuration, the bottom of the portion 92 being positioned on the rear sides of the lower and upper guide portions 88 and 90.

A release button 94 is composed of a body portion 96 and a pair of leg portions 98 extending downwardly from both lateral ends, respectively, of the body portion 96, these portions 96 and 98 being integrally molded. As is clearly shown in FIGS. 2 and 4, lever abutting walls 100 are respectively formed on two inner side portions of the body portion 96. Wedge-shaped slide guide walls 102 project from the front wall 96A of the body portion 96 so that they extend on the laterally inner side of the walls 100. The body portion 96 further has a columnar spring supporting portion 104 projecting rearwardly from the rear wall 96B thereof. A groove 106 is formed on the inner side of each of the leg portions 98, the groove 106 extending longitudinally of the release button 94. An extended portion 109 is formed at the rear end of each of the leg portions 98, the portion 109 having a lever abutting wall 107.

A spring holder 108 has a columnar spring supporting portion 110 and a portion 112 which is secured to the buckle body 16. A groove 114 is formed in the portion 112 on the side thereof which is remote from the spring supporting portion 110, the groove 114 extending laterally of the holder 108. An opening 116 having a rectangular cross-section is formed in the portion 112, the opening 116 longitudinally extending through the portion 112 so as to communicate with the groove 114. An ejector stopper spring 118 and a release button spring 120 are constituted by compression coil springs, respectively.

The following is a description of the procedure for assembling the elements detailed above.

First, the ejector 84 is disposed at the opening 30 of the lower body member 18. The ejector 84 has its lower guide portion 88 fitted into the opening 30. Then, the upper body member 20 is mounted on the lower body member 18 and assembled together. The projections 22 formed on the front leg portions 19 of the member 18 are respectively fitted into the notches 38 formed in the front leg portions 36 of the member 20. Thus, the buckle body 16 is formed. In this state, the ejector 84 has its upper guide portion 90 fitted into the opening 46 of the upper body member 20. In addition, the rear flat plate portion 18B and the tongue 34 of the lower body member 18 respectively abut against and overlap the rear flat plate portion 20B and the tongue 50 of the upper body member 20.

Then, the spring holder 108 is mounted on the buckle body 16 in such a manner that the overlapping tongues 34 and 50 are fitted into the opening 116 formed in the portion 112 of the holder 108. In consequence, the rear flat plate portions 18B and 20B of the lower and upper body members 18 and 20 are fitted together into the groove 114 formed in the portion 112, whereby the portions 18B and 20B are clamped so as to be maintained in their overlapping state.

Each of the C-shaped springs 60 has its intermediate portion fitted into the corresponding notches 28 and 44 respectively formed in the lower and upper body members 18 and 20, both end portions of each spring 60 being respectively retained by the recesses 24 and 40 formed in the members 18 and 20.

The lock plate 52 is mounted on the buckle body 16 from the upper side of the upper body member 20. The tongue plate retaining portion 54 is inserted into the opening 46, and the spring abutting portions 56 are respectively inserted into the notches 44. Further, the lock plate spring 72 is mounted in such a manner that the overlapping tongues 34 and 50 are inserted into the opening 80 formed in the portion 78 of the lock plate spring 72. In addition, one coil end of the ejector spring 118 is fitted onto the overlapping tongues 34 and 50, while the other coil end of the spring 118 is fitted onto the spring supporting portion 92 formed on the ejector 84. Thus, the ejector 84 is biased toward the left-hand side as viewed in FIG. 4 by means of the spring 118.

The tongue plate retaining portion 54 has its lower end surface abutting against the upper surface of the body portion 86 of the ejector 84 and its rear surface (the right-hand surface as viewed in FIG. 4) abutting against the front surface of the upper guide portion 90 of the ejector 84. The upper end surface of the lock plate 52 retains the respective free end portions of the leg portions 74 of the lock plate spring 72, and the lock plate 52 is thereby biased downwardly as viewed in FIG. 4.

The bar 70 is inserted into the through-holes 43 respectively formed in the side leg portions 42 of the upper body member 20. Thus, the bar 70 extends laterally across the underside of the lower body member 18. The L-shaped levers 62 are respectively fitted on both end portions of the bar 70 through their through-holes 64.

Figure 8:
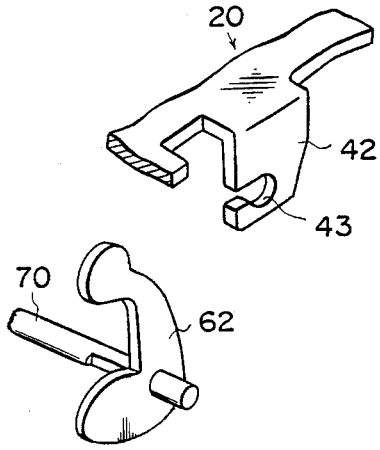
FIG. 8 is a perspective view showing a modification of the present invention which partially differs in configuration from the embodiment shown in FIGS. 1 to 7.
Figure 9:
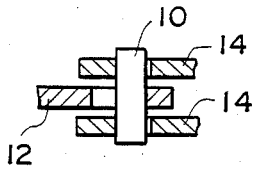
FIG-9 PRIOR ART
FIG. 9 is a sectional view which shows the principle of one type of conventional buckle apparatus.

In the case where the L-shaped levers 62 and the bar 70 are integrally molded from a synthetic resin as described above, the bar 70 may be mounted on the buckle body 16 by partially cutting each of the side leg portions 42 of the upper body member 20 as shown in FIG. 8 so that the bar 70 having the levers 62 integrated therewith can be fitted into the through-holes 43 from one side of each leg portion 42.

The release button 94 is mounted on the buckle body 16 in such a manner that both end portions of the bar 70 are respectively fitted into the grooves 106 formed in the leg portions 98 of the release button 94. Thus, the slide guide walls 102 abut against the upper surface of the upper body member 20. One coil end of the release button spring 102 is fitted onto the spring supporting portion 104 of the release button 94, while the other coil end of the spring 120 is fitted onto the spring supporting portion 110 of the spring holder 108. In consequence, the release button 94 is biased leftwardly as viewed in FIG. 4.

Figure 2:
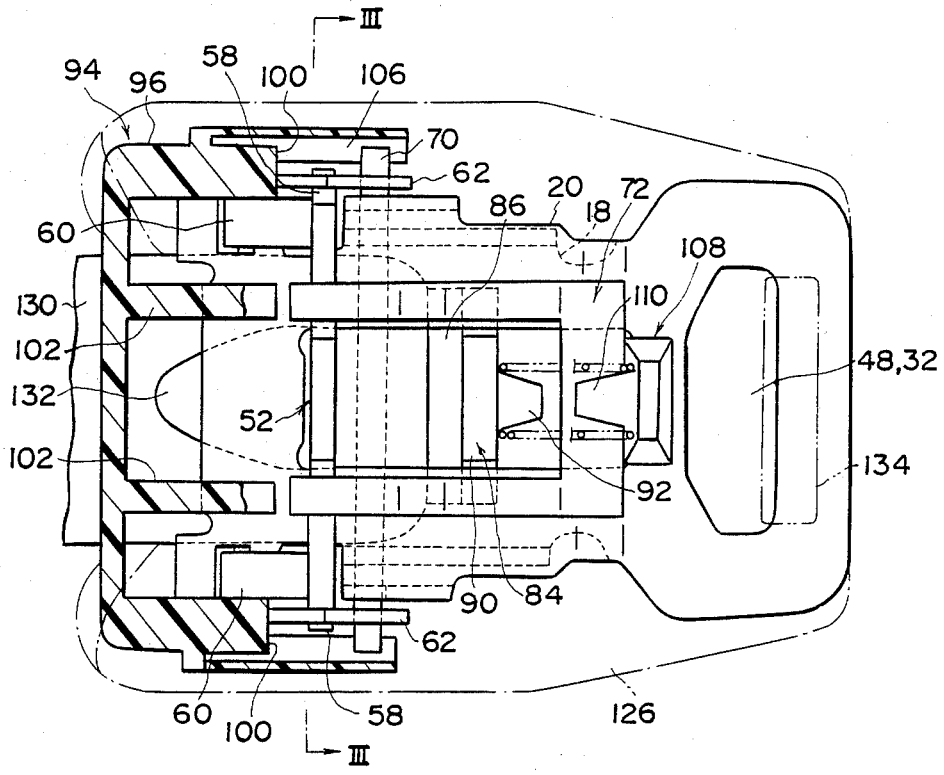
Figure 4:
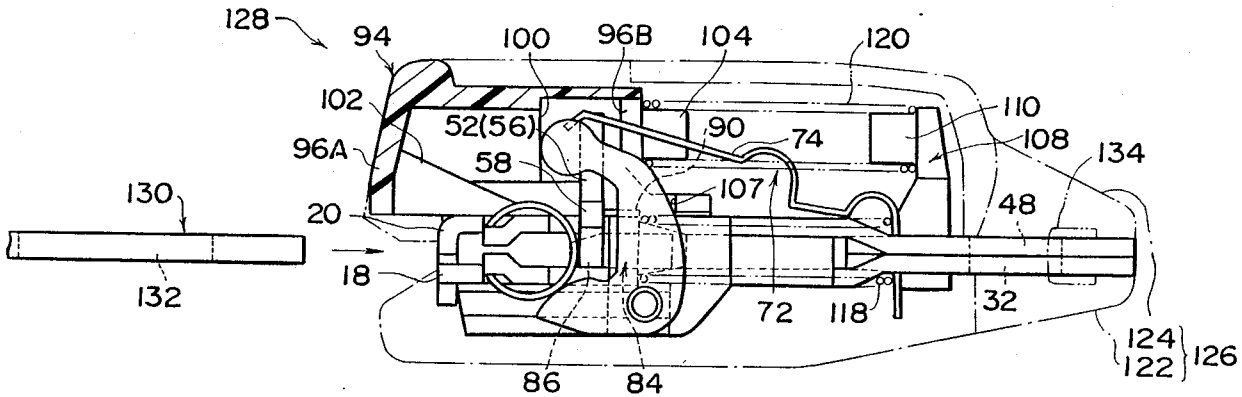

Finally, a buckle cover 126 which is constituted by a lower cover member 122 and an upper cover member 124 is mounted on the buckle body 16 as shown in FIG. 4, thus completing the assembly of the buckle apparatus 128. In addition, a protector 134 is engaged with the openings 32 and 48 respectively formed in the rear flat plate portions 18B and 20B of the overlapping lower and upper body members 18 and 20, and one end of a webbing portion (not shown) is connected to the buckle body 16 through the protector 134, the other end of this webbing portion being secured to the vehicle body through an appropriate member. A tongue plate 130 which is to be engaged with the buckle apparatus 128 is provided with an opening 132, as shown in FIGS. 2 and 4. One end of another webbing portion (not shown) is connected to the tongue plate 130, the other end of this webbing portion being secured to the vehicle body through an appropriate member.

The operation of this embodiment will be described below.

FIG. 4 shows the buckle apparatus 128 in a normal state wherein the tongue plate 130 is not engaged therewith. When the tongue plate 130 is inserted into the buckle apparatus 120 in this state from the left-hand side as viewed in FIG. 4, they are engaged with each other, thereby allowing an occupant to be fastened by the webbing.

As the tongue plate 130 is inserted into the buckle apparatus 128, the leading end of the plate 130 abuts against the front surface of the body portion 86 of the ejector 84 and presses the ejector 84 rightwardly as viewed in FIG. 4 against the biasing force of the ejector spring 118. While pressing the ejector 84, the tongue plate 130 moves further rightwardly as viewed in FIG. 4 until the opening 132 of the plate 130 reaches a position below the tongue plate engaging portion 54 of the lock plate 52.

Figure 3:
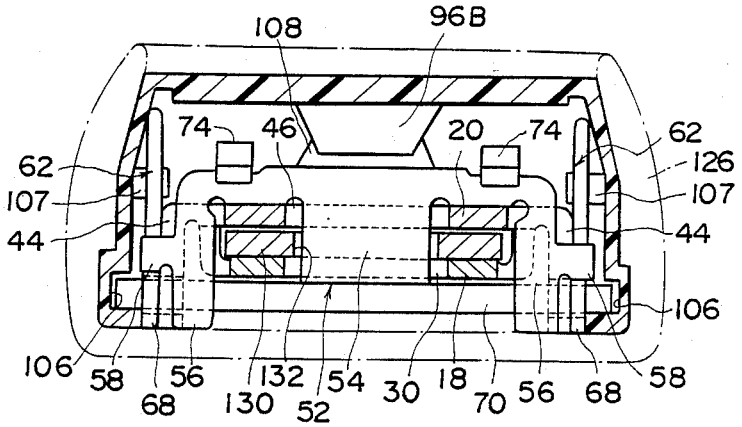

Since the lock plate 52 is biased downwardly as viewed in FIG. 4 by means of the lock plate spring 72, when the tongue plate 130 reaches the above position, the lock plate 52 moves downward, and the distal end of the tongue plate engaging portion 54 passes through the opening 30 of the lower body member 18. Thus, the tongue plate 130 is engaged with the buckle apparatus 128. This state is shown in FIGS. 2, 3 and 5.

Figure 5:
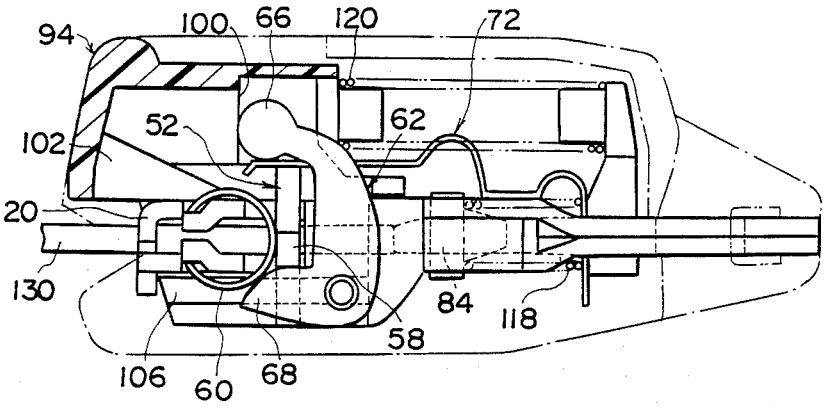

When the buckle apparatus 128 is in the state shown in FIG. 5, as the tongue plate 130 is pulled through the webbing (not shown), the lock plate 52 is moved toward the leftwardly as viewed in FIG. 5 against the biasing forces applied thereto from the C-shaped springs 60. At this time, the C-shaped springs 60 are respectively pressed by the spring abutting portions 56 of the lock plate 52 and are deformed into the shape of an oval the major axis of which extends vertically of the buckle apparatus 128 as viewed in FIG. 5.

Figure 6:
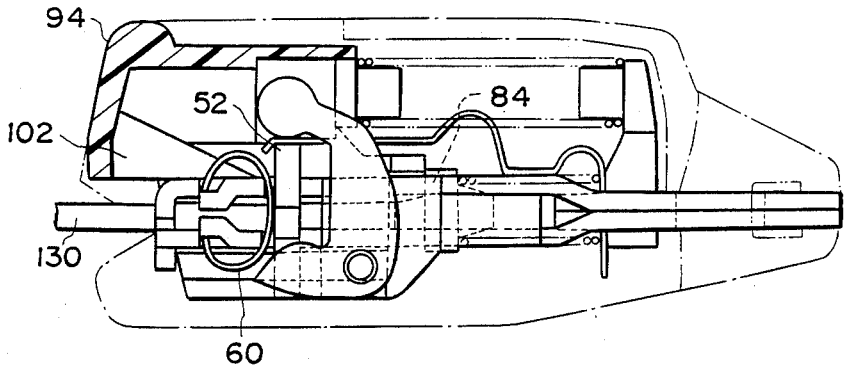

In a low-load state wherein the pulling force applied to the tongue plate 130 through the webbing is relatively small, the plate 130 is resiliently supported by the buckle body 16 through the C-shaped springs 60. In a high-load state wherein the pulling force is relatively large, the C-shaped springs 60 are elastically deformed to a large extent. In consequence, the lock plate 52 is, as shown in FIG. 6, allowed to move leftwardly (as viewed in the Figure) by a large margin, thus causing the upper and lower portions of the tongue plate engaging portion 54 to respectively abut against the front end faces of the openings 30 and 46 formed in the lower and upper body members 18 and 20 so as to be retained thereby. Accordingly, in this state, the tongue plate 130 is supported directly by the buckle body 16. When, in this state, the load decreases, the buckle apparatus 128 returns to its position in the above-described low-load state.

To disengage the tongue plate 130 from the buckle apparatus 128, the release button 94 which is in the state shown in FIG. 5 is moved rightwardly as viewed in the Figure against the biasing force of the release button spring 120. The release button 94 is moved in a state wherein the respective lower end surfaces of the slide guide walls 102 abut against the upper surface of the upper body member 20, and the lever abutting walls 100 respectively abut against the release button abutting portions 66 of the L-shaped levers 62. Accordingly, the movement of the release button 94 causes the respective release button abutting portions 66 of L-shaped levers 62 to move rightwardly as viewed in FIG. 5, which in turn causes the lock plate abutting portions 68 to pivot clockwise as viewed in FIG. 5.

Figure 7:
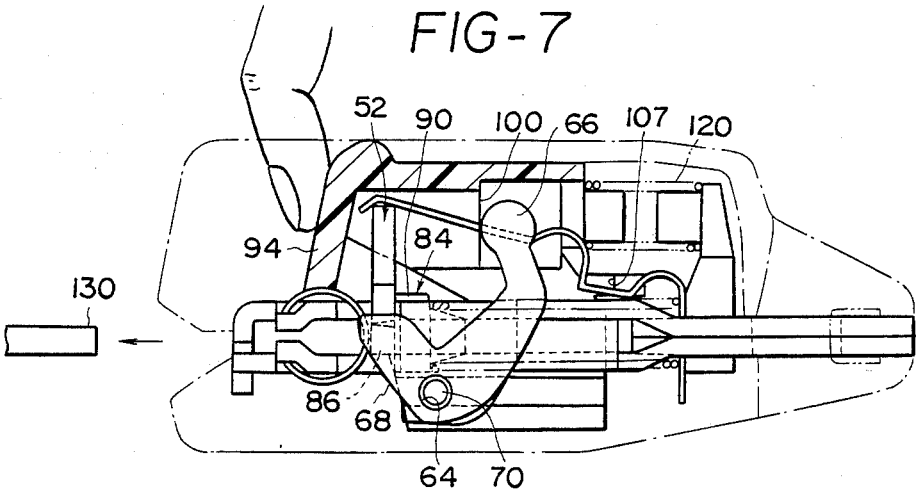

The lock plate abutting portions 68 thus pivoted respectively push the lever abutting portions 58 of the lock plate 52, thus causing the plate 52 to move upward against the biasing force applied thereto from the lock plate spring 72. In consequence, the tongue plate engaging portion 54 comes out of the opening 132 of the tongue plate 130. At the same time, the ejector 84 which is biased by means of the ejector spring 118 is moved leftwardly as viewed in FIG. 5 to press the tongue plate 130 so that it is ejected out of the buckle apparatus 128. This state is shown in FIG. 7, in which the ejector 84 has the front surface of its upper guide portion 90 abutting against the rear surface of the tongue plate engaging portion 54, whereby the ejector 84 is prevented from excessively moving leftwardly as viewed in FIG. 7. The lock plate 52 has the lower end surface of its tongue plate engaging portion 54 abutting against the upper surface of the body portion 86 of the ejector 84, whereby the lock plate 52 is prevented from moving downward.

When the release button 94 which is in the state shown in FIG. 7 is released from the pressure applied thereto for disengagement of the tongue plate 130, the button 94 which is biased by means of the release button spring 120 is moved leftwardly as viewed in FIG. 7. In consequence, the L-shaped levers 62 are respectively pressed by the lever abutting walls 107 formed on the extended portions 109, thus returning the buckle apparatus 128 to the state shown in FIG. 4.

As described above, in accordance with this embodiment, the buckle body 16 is constituted by the lower body member 18 and the upper body member 20, and the tongue plate 130 is inserted into the area defined by the body members 18 and 20. The lock plate 52 is disposed such as to be vertically movable across this area, and when the tongue plate 130 is not engaged with the lock plate 52, the plate 52 is supported being resiliently clamped by the C-shaped springs 60 and the ejector 84.

When a relatively high load acts on the lock plate 52 which is in engagement with the tongue plate 130, the C-shaped springs 60 are elastically deformed to a large extent, so that the portions of the tongue plate engaging portion 54 of the lock plate 52 which are respectively located on the lower and upper sides of the intermediate portion thereof which is engaged with the tongue plate 130 respectively abut against the lower and upper body members 18 and 20 so as to be retained thereby. Accordingly, the tongue plate 13 is supported at its two ends, which provides high engagement reliability. In addition, since the support span is short, a large tongue plate holding strength is obtained.

When a relatively low load acts on the lock plate 52 which is in engagement with the tongue plate 130, the plate 52 is resiliently supported through the C-shaped springs 60. The C-shaped springs 60 may be elastically deformed in response to a load change even within the range of relatively low loads. However, since the ejector 84 which is biased by means of the ejector spring 118 is moved through the tongue plate 130 in response to the elastic deformation of the C-shaped springs 60, there is no risk of any play or chattering occurring between the tongue plate 130 and the lock plate 52. When a high load decreases to a relatively low load, the ejector 84 is reliably returned to its previous position by means of the biasing forces of the springs 60.

Accordingly, when the lock plate 52 is pushed up by the L-shaped levers 62 during the operation of disengaging the tongue plate 130, the lock plate 52 abuts against only the C-shaped springs 60 except for its portion engaged with the tongue plate 130. Since the lock plate supporting surfaces of the buckle body 16 against which the lock plate 52 abuts when a high load acts thereon are press-cut surfaces, the surfaces are relatively rough. On the other hand, each C-shaped spring 60 is a rolled member and therefore has a relatively smooth surface. For this reason, there is no risk of the lock plate 52 being scratched when the tongue plate 130 is disengaged. In addition, even if the lock plate 52 has scratches produced as a result of the abutment against the buckle body 16, since the plate 52 is guided by the C-shaped springs 60, there is no risk of the force required for disengagement increasing in repetitive use of the seatbelt system. Since each of the L-shaped levers 62 has the function of leverage, the force required for disengagement is particularly reduced.

In addition, even if the buckle body abutting surface of the lock plate 52 should be depressed as a result of the application of a high load, since the lock plate 52 is separated from the buckle body 16 by the action of the C-shaped springs 60 when the tongue plate 130 is disengaged, there is no risk of the lock plate 52 being caught by the buckle body 16 through the depression which would make it difficult to disengage the tongue plate 130 from the buckle body 16.

What is claimed is:

1. A buckle apparatus for use in a seatbelt system for a vehicle designed to protect an occupant in an emergency situation of the vehicle, said apparatus comprising:

(a) a buckle body mounted on the vehicle body;

(b) a lock plate having a first engaging portion engaging with a tongue plate when inserted into said buckle body, and said second engaging portions provided on both sides of said first engaging portion so as to engage with said buckle body, thereby resisting the force applied to said lock plate through the engagement with said tongue plate;

(c) release means which allows said lock plate to move in response to the operation conducted by the occupant in a direction substantially orthogonal to the direction in which said tongue plate is moved, thereby allowing said tongue plate to be pulled out of said buckle body; and (d) retaining means for retaining said lock plate such that when a relatively high tensile force acts on said first engaging portion of said tongue plate through said lock plate, said second engaging portions of said lock plate are respectively engaged with said buckle body, and when a relatively low tensile force acts on said tongue plate, said retaining means moves said tongue plate so that said second engaging portions are separated from said buckle body, whereby said retaining means reduces the magnitude of the force required for actuating said release means when a relatively low tensile force acts on said tongue plate.

2. A buckle apparatus according to claim 1, wherein said buckle body includes a pair of substantially parallel plate members which partially face the second engaging portions, respectively, of said lock plate.

3. A buckle apparatus according to claim 2, wherein said pair of buckle body members are provided with respective openings end faces of which respectively face the second engaging portions of said lock plate.

4. A buckle apparatus according to claim 3, wherein said retaining means is constituted by a leaf spring which has both ends thereof respectively retained by said pair of buckle body members.

5. A buckle apparatus according to claim 4, wherein said leaf spring has a substantially C-shaped configuration, the ends of said spring being respectively retained by recesses which are formed in respective surfaces of said pair of buckle body members on the sides thereof which are remote from their opposing surfaces.

6. A buckle apparatus according to claim 5, wherein the intermediate portion of said leaf spring is inserted into a notch formed in each side surface of said buckle body so that said intermediate portion abuts against said lock plate which is also inserted into said notch and moved therein.

7. A buckle apparatus according to claim 6, wherein said lock plate has a tongue plate engaging portion formed at its approximate center and retaining means engaging portions respectively formed at two end portions thereof, said tongue plate engaging portion being inserted into the openings of said pair of buckle body members, and said retaining means engaging portions being respectively inserted into the notches of said buckle body.

8. A buckle apparatus according to claim 7, wherein said release means has its intermediate portion pivotally supported by said buckle body, one end thereof facing a release button and the other end facing said lock plate, whereby the operating force applied to said release button is changed into a large force for moving said lock plate by means of leverage.

9. A buckle apparatus for use in a seatbelt system for a vehicle designed to protect an occupant in an emergency situation of the vehicle, said apparatus comprising:

(a) a buckle body mounted on the vehicle body;

(b) a lock plate having a first engaging portion engaging with a tongue plate when inserted into said buckle body, and second engaging portions provided on both sides of said first engaging portion so as to engage with said buckle body, thereby resisting the force applied to said lock plate through the engagement with said tongue plate;

(c) release means which allows said lock plate to move in response to the operation conducted by the occupant in a direction substantially orthogonal to the direction in which said tongue plate is moved, thereby allowing said tongue plate to be pulled out of said buckle body; and (d) retaining means for retaining said lock plate, wherein said retaining means is a resilient member which retains said lock plate at a position at which said tongue plate is inserted into said buckle body to a relatively large extent when the tension acting on said tongue plate is relatively low, while when said tension increases, said resilient member is elastically deformed so as to allow said lock plate to move to a position at which said tongue plate is inserted into said buckle body to a relatively lesser extent such that when a relatively high tensile force acts on said tongue plate, said second engaging portions of said lock plate are respectively engaged with engaging portions of said buckle body, while when a relatively low tensile force acts on said tongue plate, said retaining means moves said tongue plate in the direction in which said tongue plate is inserted so that said second engaging portions are separated from said buckle body, whereby said retaining means reduces the magnitude of the force required for actuating said release means when a relatively low tensile force acts on said lock plate, thereby facilitating the operation of said release means.

10. A buckle apparatus according to claim 9, wherein said resilient member is a leaf spring having both ends thereof supported by said buckle body and its intermediate portion facing said lock plate.

11. A buckle apparatus according to claim 10, wherein the intermediate portion of said resilient member faces said lock plate at an inner position within said buckle body than the ends of said resilient member in terms of the tongue plate inserting direction.

12. A buckle apparatus according to claim 11, wherein said resilient member has a substantially C-shaped configuration.

13. A buckle apparatus employed in a seatbelt system for a vehicle design to protect an occupant in an emergency situation of the vehicle, said apparatus being used for engagement with a tongue plate connected to a webbing, said apparatus comprising:

(a) an elongated buckle body mounted on the vehicle body, said buckle body constituted by a pair of buckle body members which are secured substantially parallel to each other such as to define an area for insertion of said tongue plate therebetween;

(b) a lock plate movable in a direction substantially orthogonal to the direction in which said tongue plate is inserted into the area defined between said buckle body members so that said lock plate engages with an opening provided in said tongue plate and further movable into and out of engagement with a supporting portion of said buckle;

(c) supporting means provided between said lock plate and said buckle body and respectively disposed on both sides of respective portions of said lock plate and said buckle body which are engaged with each other, thereby reliably supporting said lock plate;

(d) release means which allows said lock plate to be moved in a direction substantially orthogonal to the tongue plate inserting direction by means of the operating force applied to said release means by the occupant, thereby allowing said tongue plate to be pulled out of said buckle body; and (e) retaining means for urging said lock plate away from engagement with said supporting portion of said buckle body when said lock plate is subjected to a relatively low tensile force, but while allows said tongue plate to move into engagement with said supporting portion of said buckle when subjected to a high tensile force indicative of a vehicular emergency, whereby the magnitude of the force required for actuating said release means under low tensile force is reduced.

14. A buckle apparatus employed in a seatbelt system for a vehicle designed to protect an occupant in an emergency situation of the vehicle, said apparatus being used for engagement with a tongue plate connected to a webbing, said apparatus comprising:

(a) a buckle body mounted on the vehicle body, said buckle body being constituted by a pair of buckle body members which are secured substantially parallel to each other such as to define an area for insertion of said tongue plate therebetween;

(b) a lock plate moving in a direction substantially orthogonal to the direction in which said tongue plate is inserted into the area defined between said buckle body members so that said lock plate engages with an opening provided in said tongue plate;

(c) supporting means provided between said lock plate and said buckle body and respectively disposed on both sides of respective portions of said lock plate and said buckle body which are engaged with each other, thereby reliably supporting said lock plate;

(d) release means which allows said lock plate to be moved in a direction substantially orthogonal to the tongue plate inserting direction by means of the operating force applied to said release means by the occupant, thereby allowing said tongue plate to be pulled out of said buckle body; and (e) retaining means for retaining said lock plate such that when said lock plate and said tongue plate are in engagement with each other and the force applied to said tongue plate such as to pull it out from said buckle body is relatively small, wherein said retaining means moves said lock plate in the direction in which said tongue plate is inserted into said buckle body so as to disengage said supporting means of said lock plate and said buckle body from each other when said tongue plate is subjected to a relatively small tensile force, thereby reducing the magnitude of the force required for actuating said release means, wherein said lock plate has a tongue plate engaging portion formed at the approximate center thereof, said tongue plate engaging portion being inserted into an opening formed in said buckle body, and said lock plate further having each of the two end portions thereof formed with a portion of said supporting means.

15. A buckle apparatus according to claim 14, wherein said release means has its intermediate portion pivotally supported by said buckle body, one end thereof facing a release button and the other end facing said lock plate, whereby the operating force applied to said release button is changed into a large force for moving said lock plate by means of leverage.

16. A buckle apparatus according to claim 14, wherein said retaining means is a resilient member.

17. A buckle apparatus according to claim 16, wherein said resilient member is a leaf spring having both ends thereof supported by said buckle body and its intermediate portion facing said lock plate.

18. A buckle apparatus according to claim 17, wherein the intermediate portion of said resilient member faces said lock plate at an inner position within said buckle body than the ends of said resilient member in terms of the tongue plate inserting direction.

19. A buckle apparatus according to claim 18, wherein said resilient member has a substantially C-shaped configuration.

20. A buckle apparatus according to claim 18, wherein the intermediate portion of said leaf spring is inserted into a notch formed in each side surface of said buckle body so that said intermediate portion abuts against said lock plate which is also inserted into said notch and moved therein.

21. A buckle apparatus employed in a seatbelt system for a vehicle for engagement with a tongue plate, said apparatus comprising:

(a) a buckle body having one end thereof mounted on the vehicle body, said buckle body being formed of a pair of substantially parallel plate members which are joined together such as to define a tongue plate inserting area therebetween;

(b) a lock plate having a tongue plate engaging portion insertable into an opening formed in said buckle body such that when said tongue plate engaging portion is inserted into and engaged with an opening provided in said tongue plate, said tongue plate becomes engaged with said lock plate, wherein said lock plate further includes at least one buckle body engaging portion that is movably engageable into a supported position with respect to said buckle body;

(c) release means for applying force to abutting portions respectively projecting from both sides of said tongue plate engaging portion in response to the operation conducted by the occupant so that said lock plate is moved in a direction orthogonal to the tongue plate inserting direction, thereby allowing said tongue plate engaging portion to be pulled out of the opening of said tongue plate; and (d) a resilient member constituted by a leaf spring having both ends thereof supported by said buckle body, the intermediate portion of said resilient member urging said buckle body engaging portion of said lock plate away from the buckle body so that said buckle body engaging portion moves into said supported position only when the resiliency of said member is overcome as a result of a relatively large tensile force acting on said tongue plate.

22. A buckle apparatus according to claim 21, wherein said resilient member has a substantially C-shaped configuration.

23. A buckle apparatus according to claim 21, wherein two ends of said leaf spring are respectively retained by recesses which are formed in respective surfaces of said pair of buckle body members on the sides thereof which are remote from their opposing surfaces.

24. A buckle apparatus according to claim 23, wherein the intermediate portion of said leaf spring is inserted into a notch formed in each side surface of said buckle body so that said intermediate portion abuts against said lock plate which is also inserted into said notch and moved therein.

* * * * *